US011866954B1

(12) United States Patent
Morales

(10) Patent No.: US 11,866,954 B1
(45) Date of Patent: Jan. 9, 2024

(54) POOL LADDER ANCHOR SOCKET COVER

(71) Applicant: Hugo E. Morales, Lanoka Harbor, NJ (US)

(72) Inventor: Hugo E. Morales, Lanoka Harbor, NJ (US)

( * ) Notice: Subject to any disclaimer, the term of this patent is extended or adjusted under 35 U.S.C. 154(b) by 0 days.

(21) Appl. No.: 17/946,186

(22) Filed: Sep. 16, 2022

Related U.S. Application Data

(60) Provisional application No. 63/244,994, filed on Sep. 16, 2021.

(51) Int. Cl.
*E04H 4/14* (2006.01)

(52) U.S. Cl.
CPC ..... *E04H 4/144* (2013.01)

(58) Field of Classification Search
CPC ..... E04H 4/14; E04H 4/144
USPC ..... 4/496
See application file for complete search history.

(56) References Cited

U.S. PATENT DOCUMENTS

| | | | | |
|---|---|---|---|---|
| 5,040,251 | A | 8/1991 | Hanford | |
| 7,055,807 | B2 | 6/2006 | Pesta | |
| 7,146,657 | B2 | 12/2006 | Jahnke | |
| 7,207,416 | B1 | 4/2007 | Parker | |
| 10,287,793 | B1 | 5/2019 | Anslem et al. | |
| D896,402 | S | 9/2020 | Geise | |
| 10,927,563 | B2 | 2/2021 | Geise | |
| 2004/0199990 | A1* | 10/2004 | Weimer | A63B 5/10 4/496 |
| 2008/0209829 | A1 | 9/2008 | Lucas | |
| 2014/0053330 | A1 | 2/2014 | Butera et al. | |

* cited by examiner

*Primary Examiner* — Tuan N Nguyen
(74) *Attorney, Agent, or Firm* — Goldstein Law Offices, P.C.

(57) ABSTRACT

A protective cover for preventing water and debris from entering a pool ladder anchor socket embedded in a pool deck surface, the socket having a hollow sleeve portion, an aperture, a flange surrounding the aperture, and a tightening projection projecting upwardly from the flange, the protective cover comprising a cap and a plug formed of compressible elastic material, the plug is inserted through the aperture to create a watertight seal which protects the sleeve portion, while the cap has a cap recess which is aligned with and encloses the tightening projection, allowing the cap to achieve flush contact with the flange.

9 Claims, 7 Drawing Sheets

POOL LADDER ANCHOR SOCKET COVER

CROSS-REFERENCE TO RELATED APPLICATIONS

This application is a nonprovisional utility application of provisional patent application, Ser. No. 63/244,994 filed in the United States Patent Office on Sep. 16, 2021, claims priority therefrom, and is expressly incorporated herein by reference in its entirety.

TECHNICAL FIELD

The present disclosure relates generally to a swimming pool winterization device. More particularly, the present disclosure relates to a protective cover for use with a pool ladder anchor socket.

BACKGROUND

Swimming pools typically include pool ladders which allow swimmers to safely enter and exit the water. Pool ladders are anchored to anchor sockets embedded on a pool deck which surrounds the swimming pool. The anchor sockets further allow the pool ladders to be removed to allow the swimming pool to be covered with a pool cover, thus protecting the pool water from debris during extended periods of inactivity. Anchor sockets have a sleeve portion surrounded by a flange which is level with the surface of the pool deck surface. However, once the pool ladder has been detached from an anchor socket, the exposed anchor collects water and debris within the sleeve portion, further resulting in damage to the metal of the anchor socket due to corrosion, or damage to the pool deck from ice expansion.

A need exists for a protective cover with a plug which forms a watertight seal with the anchor socket, and further protects the flange of the anchor socket via a flush fitting cap.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a protective cover for an anchor socket of a swimming pool ladder which prevents moisture and debris from entering. The anchor socket is embedded in a pool deck surface, and has sleeve portion which opens upwardly through an aperture. Accordingly, the present disclosure provides a protective cover with a cap and a plug projecting therefrom. The plug is adapted to be inserted into the sleeve portion to block entry of moisture and debris through the aperture and into the anchor socket.

It is another aspect of an example embodiment in the present disclosure to provide a protective cover which fits flush against the anchor socket. The anchor socket has a flange which surrounds the aperture, and a tightening projection which projects upwardly from the flange. Accordingly, the cap has an upper surface, a lower surface, and a cap recess which extends from the lower surface towards the upper surface. When the protective cover is installed in the anchor socket, the cap is rotated to align with the cap recess with the tightening projection to prevent the tightening projection from obstructing contact between the lower surface and the flange. The cap recess is adapted to receive the tightening projection, allowing the lower surface of the cap to fit flush against the flange of the anchor socket.

It is yet another aspect of an example embodiment in the present disclosure to provide protective cover which creates a watertight seal with the anchor socket. Accordingly, the plug has a diameter which matches the aperture, and is formed from a compressible material which allows the plug to compress within the aperture to create a watertight seal.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
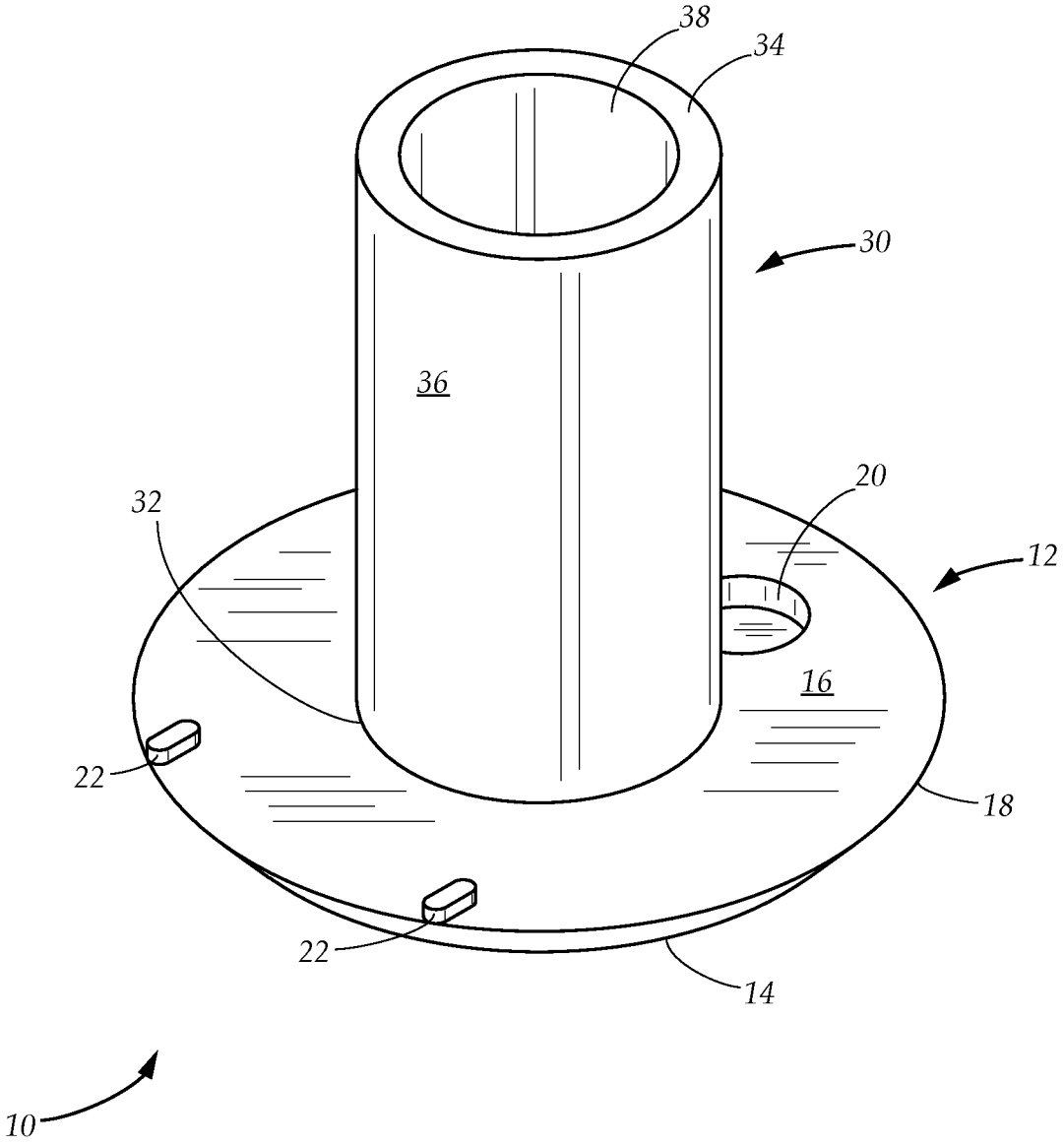
FIG. 1 is diagrammatical perspective view of a protective cover with a cap and a plug, in accordance with an embodiment in the present disclosure.
Figure 4:
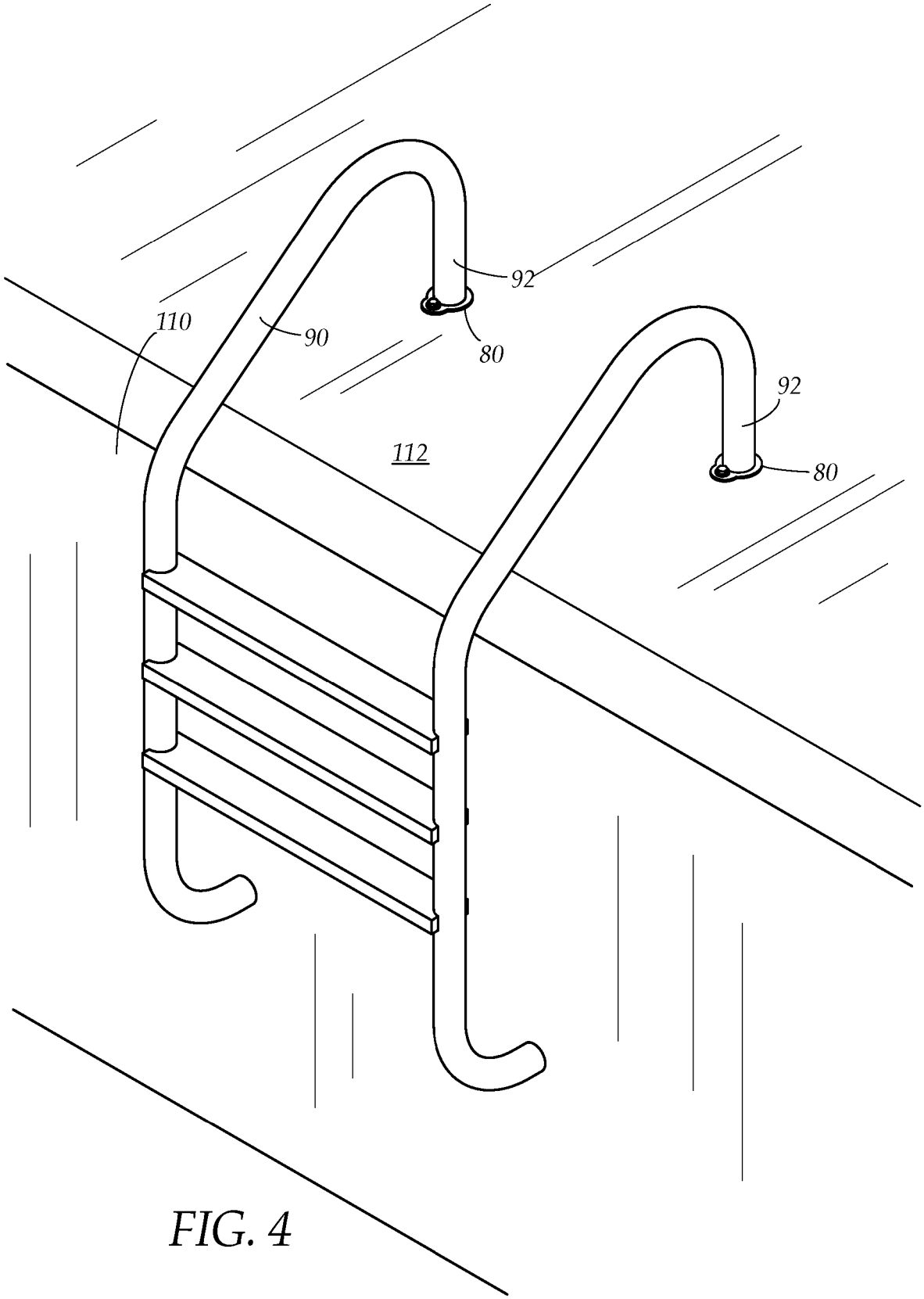
FIG. 4 is diagrammatical perspective view of a pool, pool deck surface, and a pool ladder, in accordance with an embodiment in the present disclosure.
Figure 5:
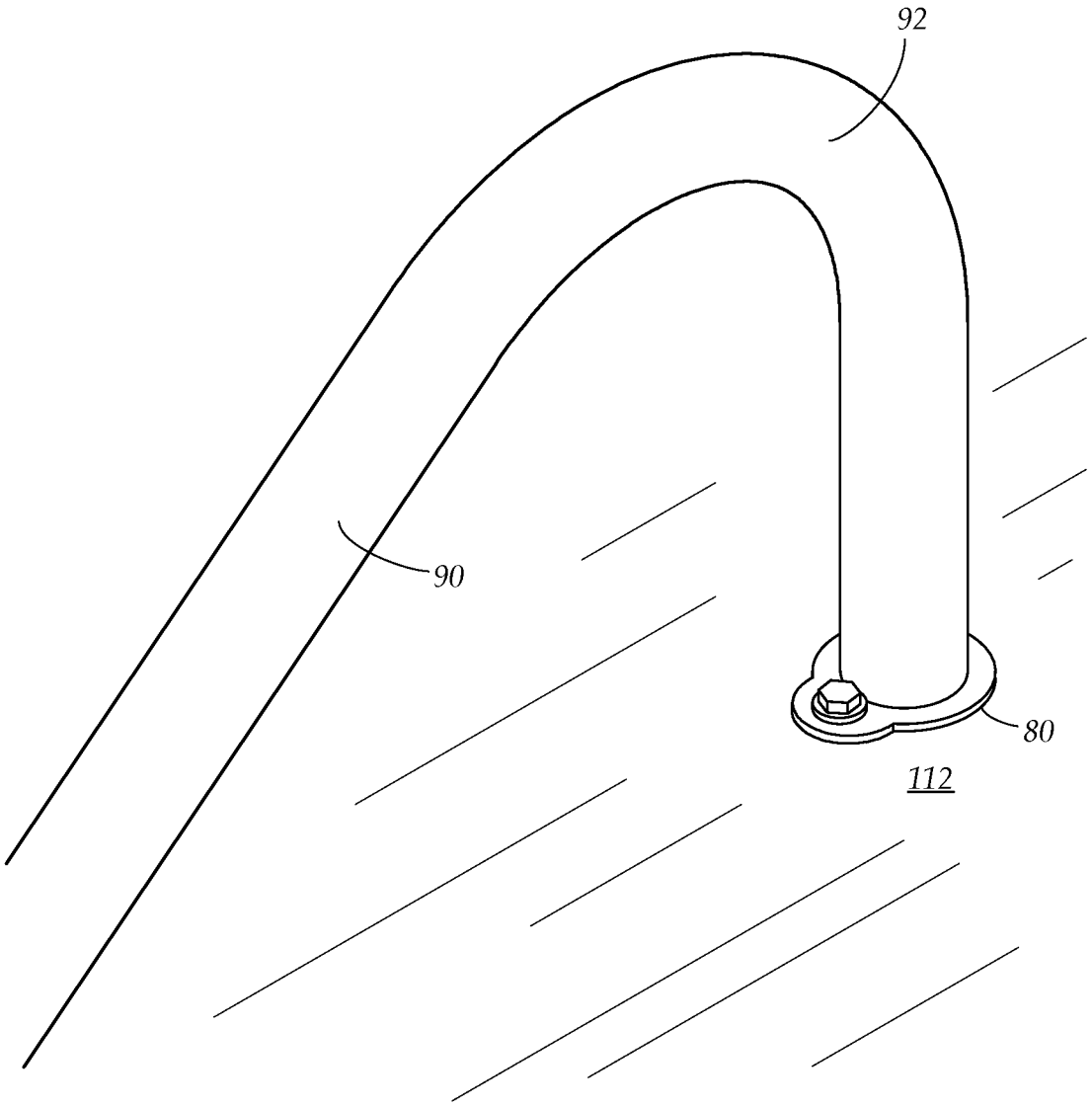
FIG. 5 is diagrammatical perspective view of an anchor socket embedded into the pool deck surface which anchors the pool ladder, in accordance with an embodiment in the present disclosure.

FIG. 1 and FIG. 4 illustrate a protective cover 10 for preventing moisture and debris from entering an exposed anchor socket 80. A typical swimming pool 110 is surrounded by a pool deck with a pool deck surface 112, and has a pool ladder 90 which allows a person to enter and exit the pool 110. Anchor sockets 80 are embedded within the pool deck surface 112 surrounding the swimming pool 110, and allow the pool ladder 90 to be removably anchored to the pool deck surface 112.

Figure 6:
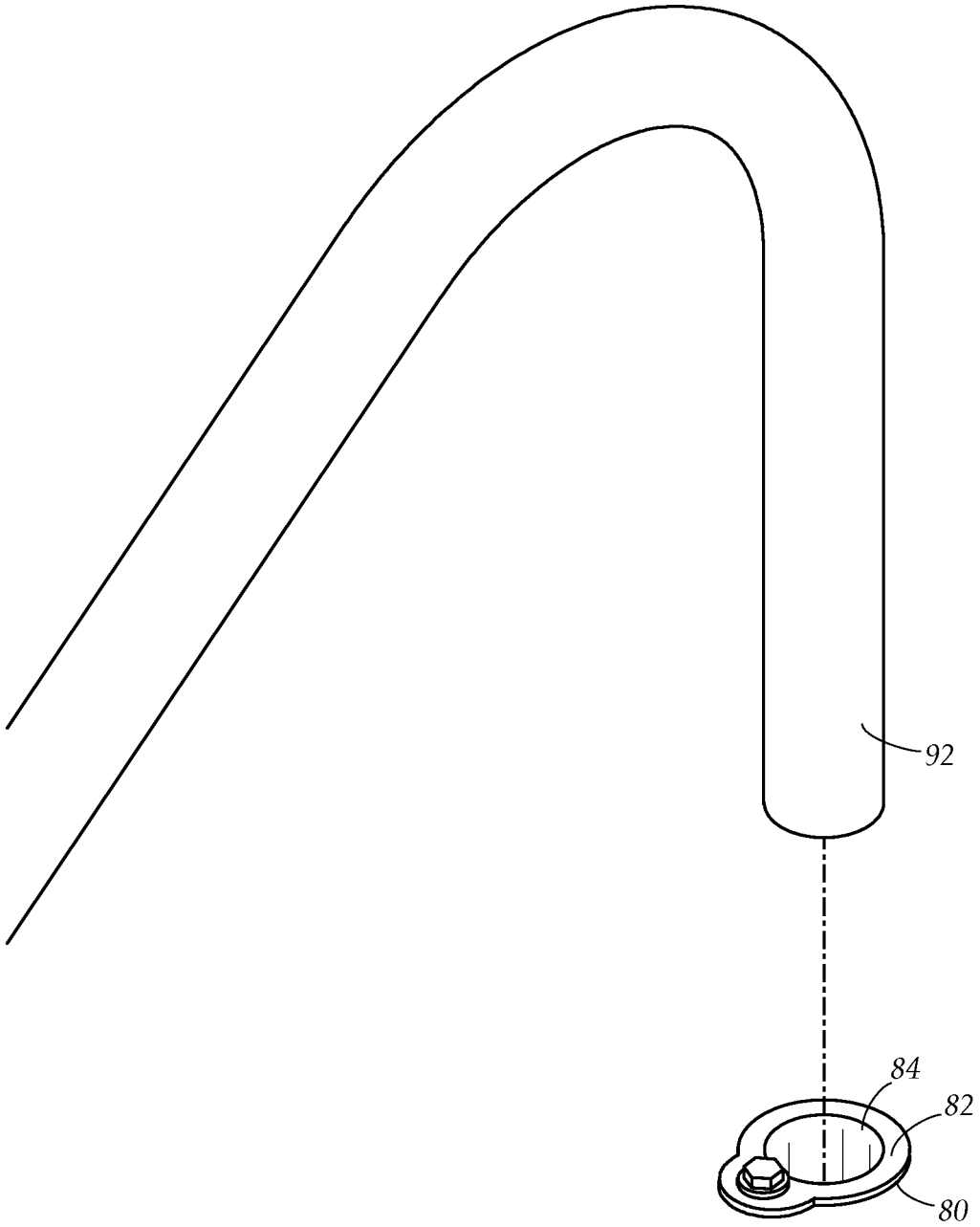
FIG. 6 is diagrammatical perspective view showing the pool ladder being detached, by removing a ladder support leg from an aperture of the anchor socket, in accordance with an embodiment in the present disclosure.
Figure 7:
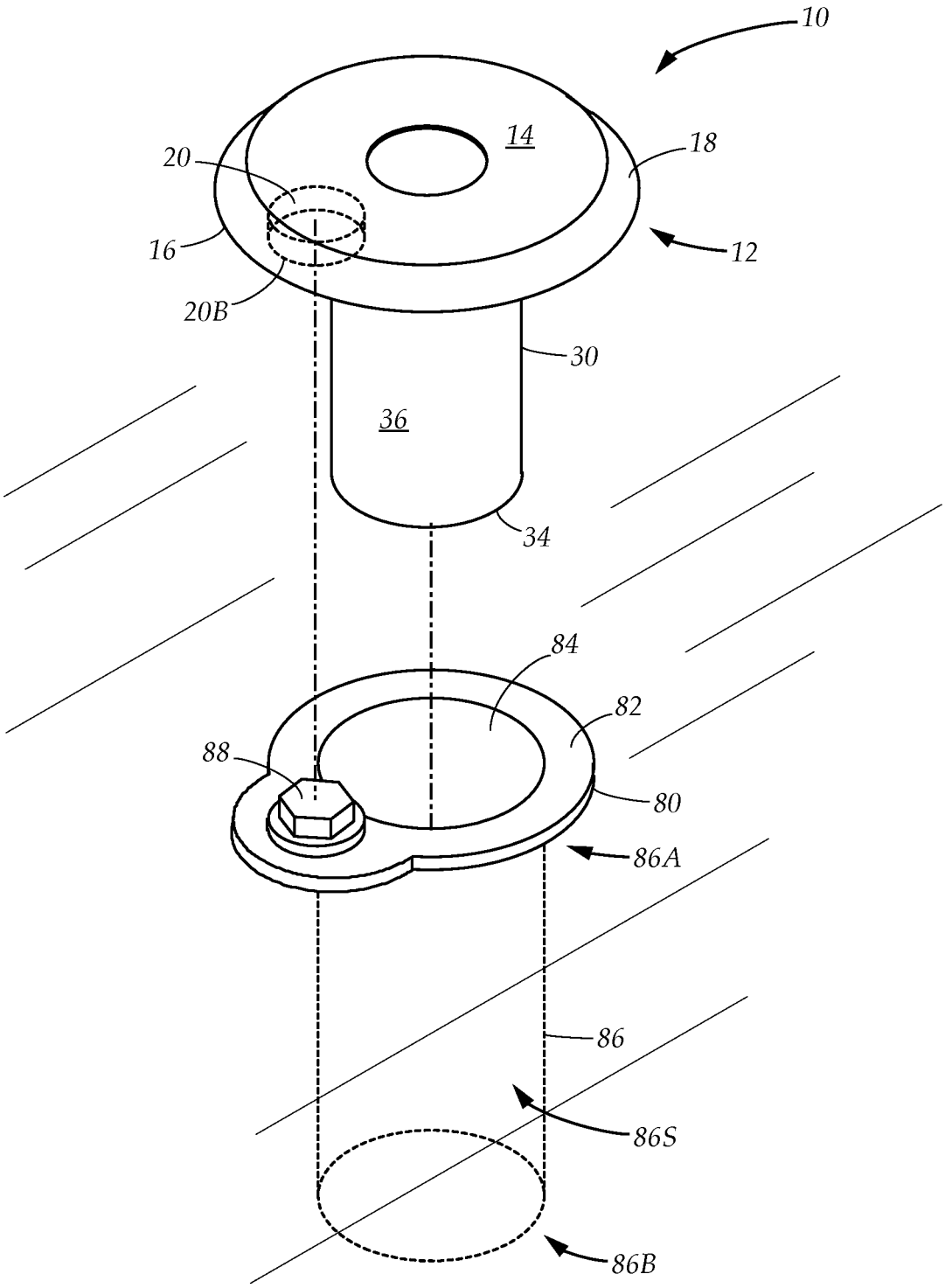
FIG. 7 is diagrammatical perspective view showing the protective cover being placed over the anchor socket, with the plug being inserted through the aperture, and the cap recess aligned with a tightening projection extending upwardly from the flange, in accordance with an embodiment in the present disclosure.

Referring to FIG. 6 and FIG. 7, the anchor socket 80 is embedded within the pool deck surface 112, and comprises a hollow sleeve portion 86 with an upper end 86A, a lower end 86B, and an interior space 86S defined therebetween. Typically, the sleeve portion 86 and the interior space 86S are cylindrical in shape. The upper end 86A has an aperture 84 which provides access into the interior space 86S of the sleeve portion 86. The anchor socket 80 further has a flange 82 which projects outwardly around the aperture 84. The flange 82 is generally configured as a circular plate, and has a flange upper surface 82S, with the aperture 84 also being circular in shape. The flange 82 rests against the pool deck surface 112, while the sleeve portion 86 extends downwardly beneath the pool deck surface 112. The anchor socket 80 further has a tightening mechanism projection 88 extending upwardly from the flange 82, configured for adjusting a tightening mechanism.

Referring to FIGS. 4-7, the pool ladder 90 has one or more support legs 92. Each support leg 92 may be inserted into the aperture 84 of one of the anchor sockets 80 to be held in place within the sleeve portion 86. The tightening mechanism releasably grips the support leg 92 within the interior space 86S of the sleeve portion 86. Typically, the support legs 92 and the sleeve portion 86 are cylindrical in shape. When the pool ladder 90 is removed, the support leg 92 is lifted upwardly out of the sleeve portion 86, and the aperture 84 becomes exposed, which allows moisture and debris to accumulate within the sleeve portion 86.

Figure 2:
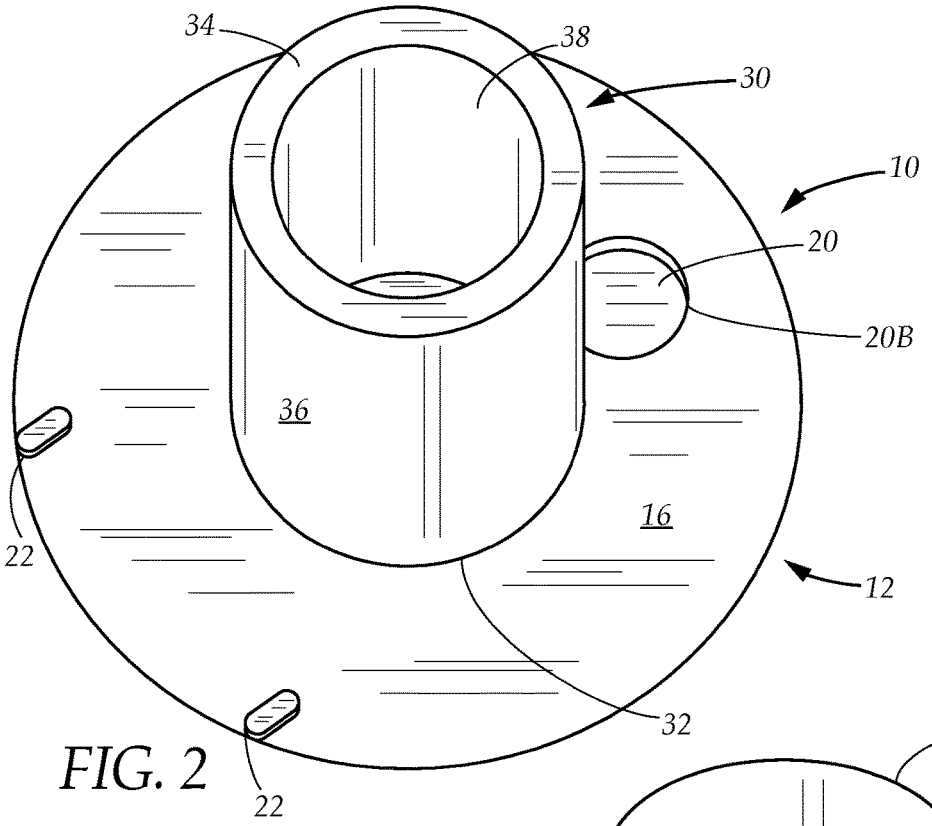
FIG. 2 is diagrammatical perspective view of the protective cover, showing lower surface of the cap, a cap recess formed in the lower surface, and a hollow cavity formed in the plug, in accordance with an embodiment in the present disclosure.
Figure 3:
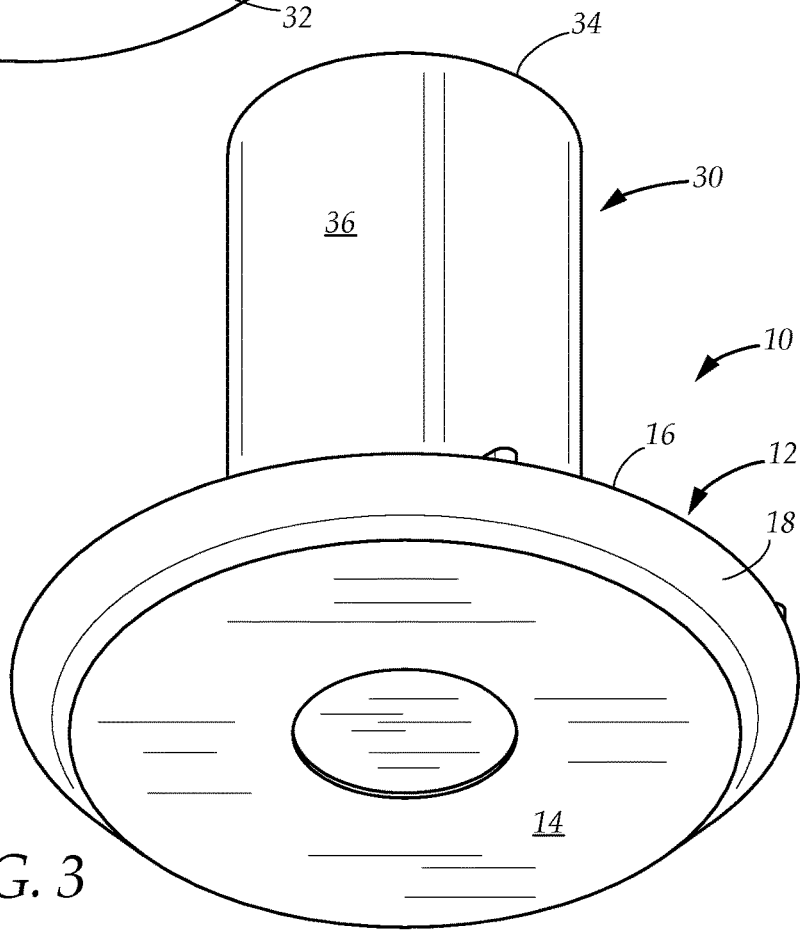
FIG. 3 is diagrammatical perspective view of the protective cover showing an upper surface of the cap, in accordance with an embodiment in the present disclosure.

Turning to FIG. 2 and FIG. 3, while also referring to FIG. 7, the protective cover 10 comprises a cap 12 having an upper surface 14, a lower surface 16 disposed opposite thereto, a cap outer edge 18, and a plug 30 which projects from the lower surface 16. The plug 30 is adapted to be inserted into the sleeve portion 86 of the anchor socket 80 until the cap 12 rests against the flange 82. The plug 30 has a first end 32 which is joined to the lower surface 16 of the cap 12, a distally oriented second end 34, and a plug surface 36 extending therebetween. In a preferred embodiment, the plug 30 is cylindrical in shape, and has a diameter which is substantially equal to the diameter of the aperture 84 of the anchor socket 80, as well as the diameter of the interior space 86S. The plug 30 is formed of an elastic, compressible material such as PVC, rubber, or other similar material. The plug 30 is therefore adapted to be inserted through the aperture 84 to form a watertight seal between the plug surface 36 and the aperture 84, which prevents entry into the sleeve portion 86 of the anchor socket 80 by moisture or debris.

In some embodiments, the diameter of the plug 30 may be slightly greater than the diameter of the aperture 84 or the interior space 86S. However, the compressibility of the plug 30 allows the plug 30 to deform sufficiently to enter the interior space 86S. In certain embodiments, the plug 30 may have a hollow cavity 38 extending upwardly from the second end 34, which aids compressibility.

Referring to FIG. 7 along with FIGS. 2-3, the protective cover 10 is pushed downwardly until the lower surface 16 of the cap 12 rests against the flange upper surface 82S. In a preferred embodiment, the cap 12 is circular in shape, and has a diameter which is sufficiently wide to cover the entirety of the flange upper surface 82S. The cap 12 has a thickness as measured between the upper face 14 and the lower face 16. The cap 12 further has a cap recess 20 formed as a void which extends from the lower surface 34 towards the upper surface 14. The cap recess 20 opens downwardly away from the lower surface 16 to form a cap recess aperture 20B, and has a depth which does not exceed the thickness of the cap 12.

When the protective cover 10 is installed, the cap 12 is rotated to place the cap recess aperture 20B in vertical alignment with the tightening projection 88. As the cap 12 is lowered towards the flange upper surface 82S, the cap recess aperture 20B allows the tightening projection 88 to pass upwardly through the lower surface 16 of the cap 12 and into the cap recess 20, thus preventing the tightening projection 88 from abutting against the lower surface 16 and preventing contact between the lower surface 16 and the flange upper surface 82S.

Figure 8:
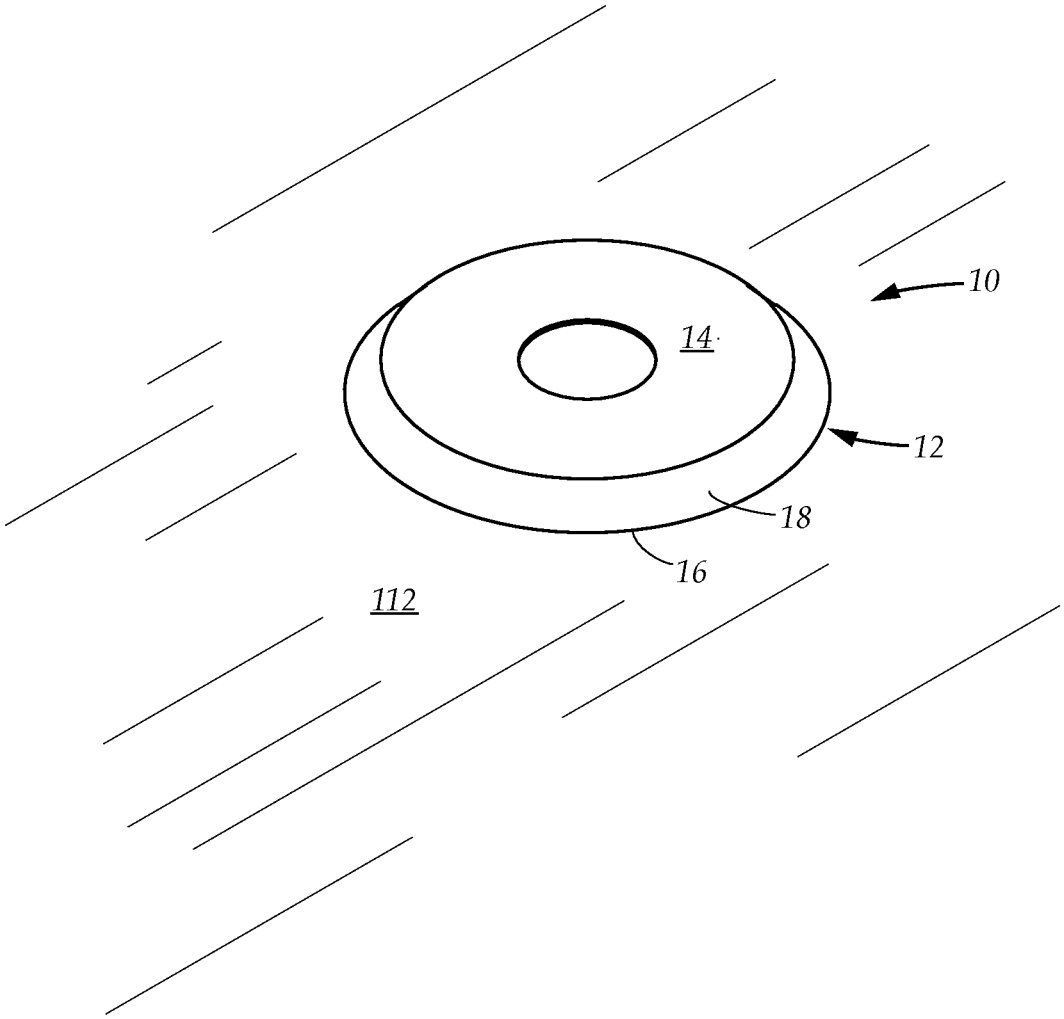
FIG. 8 is diagrammatical perspective view showing the cap of the protective cover fully covering the anchor socket, in accordance with an embodiment in the present disclosure.

Referring to FIG. 8 while also referring to FIG. 7, the cap 12 fully covers the flange 82, and protects the flange upper surface 82S from contact with precipitation. The protective cover 10 may be removed by gripping the cap 12 and pulling upwardly to extract the plug 30 from the sleeve portion 86 of the anchor socket 80. In an embodiment where the protective cover 10 is formed as a unitary component where the cap 12 and the plug 30 are formed from one continuous piece of material, the plug 30 is unlikely to tear or separate from the cap 12 when the plug 30 is extracted from the anchor socket 80.

In certain use cases, the flange 82 may be partially sunken within a recess in the pool deck surface 112, thus preventing the lower surface 16 of the cap 12 from contacting the flange upper surface 82S. However, the cap 12 can be configured such that the diameter is wider than the recess in the pool deck surface 112, allowing the lower surface 16 of the cap 12 to rest upon and create a seal with the pool deck surface 112 which prevents moisture and debris from entering the recess and contacting the flange 82.

Referring to FIG. 1, in a preferred embodiment, the cap 12 and the plug 30 are formed as a unitary piece of compressible material. However, in alternate embodiments, the cap 12 may be formed as a separate component in plastic, rubber, or other suitable material, with the plug first end 32 being attached to the lower surface 16 of the cap 12 using adhesives or another suitable fastening means.

Referring to FIG. 1 and FIG. 7, in certain embodiments, the protective cover 10 may further comprise one or more spacer projections 22 which extend from lower surface 16 of the cap. The spacer projections 22 are positioned adjacent to the cap outer edge 18, and do not obstruct the contact between the lower surface 16 and the flange upper surface 82S. The spacer projections 22 may be used to create a gap between the cap lower surface 16 and the pool deck surface 112 at the cap outer edge 18.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a protective cover for a pool ladder anchor socket. The disclosure is illustrated by example in the drawing figures, and throughout the written description. It should be understood that numerous variations are possible, while adhering to the inventive concept. Such variations are contemplated as being a part of the present disclosure.

What is claimed is:

1. A protective cover for use with an anchor socket, the anchor socket is positioned upon a pool deck surface, the anchor socket has a hollow sleeve portion extending downwardly away from the pool deck surface, an aperture which provides access to the hollow sleeve portion, a flange which surrounds the aperture, and a tightening projection which projects upwardly from the flange away from the pool deck surface, the protective cover comprising:

a cap having a cap outer edge, an upper surface, and a lower surface disposed opposite the upper surface;

a plug which is cylindrical in shape, the plug has a first end and a distally oriented second end, the first end of the plug is connected to the lower surface, and the second end projects perpendicularly away from the lower surface;

a cap recess disposed on the lower surface of the cap between the cap outer edge and the first end of the cylindrical plug, the cap recess extending inwardly from the lower surface of the cap toward the upper surface;

wherein the plug is adapted to be inserted into the hollow sleeve potion of the anchor socket via the aperture; and wherein the cap recess is adapted to receive the tightening projection of the anchor socket, allowing the lower surface of the cap to rest against the flange.

2. The protective cover as described in claim 1, wherein:

the cap is circular in shape, and the first end of the plug is disposed centrally upon the lower surface of the cap.

3. The protective cover as described in claim 2, wherein:

the plug is formed of a compressible elastic material, allowing the plug to compress within the aperture of the anchor socket and form a watertight seal.

4. The protective cover as described in claim 3, wherein:

the plug has a hollow cavity which extends from the second end of the plug towards the first end, the hollow cavity facilitates inward compression of the plug.

5. The protective cover as described in claim 4, wherein:

the cap and the plug are configured as a unitary piece formed from the compressible elastic material.

6. A method for protecting an anchor socket, the anchor socket is positioned upon a pool deck surface, the anchor socket has a hollow sleeve portion extending downwardly away from the pool deck surface, an aperture which provides access to the hollow sleeve portion, a flange which surrounds the aperture, and a tightening projection which projects upwardly from the flange away from the pool deck surface, the method comprising the steps of:

providing a protective cover, the protective cover comprising a cap with an upper surface and a lower surface, a plug that projects perpendicularly away from the lower surface, and a cap recess disposed on the lower surface that extends from the lower surface towards the upper surface;

inserting the plug into the aperture and aligning the cap recess with the tightening projection;

lowering the plug into the hollow sleeve portion of the anchor socket, allowing the tightening projection to enter the cap recess, and resting the lower surface of the cap against the flange of the anchor socket.

7. The method as recited in claim 6, wherein:

the plug is formed of a compressible elastic material; and the step of inserting the plug further comprises compressing the plug inwardly to allow the plug to pass through the aperture, and forming a watertight seal between the plug and the aperture which prevents entry of moisture into the hollow sleeve portion of the anchor socket.

8. The method as recited in claim 7, wherein:

the step of providing the protective cover is followed by the step of removing a pool ladder from the anchor socket and exposing the hollow sleeve portion.

9. The method as recited in claim 7, wherein:

the cap and the plug are both formed from the compressible elastic material; and the step of resting the lower surface of the cap against the flange is followed by the step of elastically bending the cap and lifting the cap outer edge away from the pool deck surface, and removing the plug from the anchor socket by grasping the cap and pulling away from the pool deck surface.

* * * * *